US007420330B2

(12) United States Patent
Woo et al.

(10) Patent No.: US 7,420,330 B2
(45) Date of Patent: Sep. 2, 2008

(54) PLASMA DISPLAY PANEL HAVING IMPROVED EFFICIENCY

(75) Inventors: Seok-Gyun Woo, Asan-si (KR); Se-Jong Kim, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/279,034

(22) Filed: Apr. 7, 2006

(65) Prior Publication Data

US 2006/0164335 A1 Jul. 27, 2006

Related U.S. Application Data

(63) Continuation of application No. 10/917,319, filed on Aug. 13, 2004, now Pat. No. 7,095,174.

(30) Foreign Application Priority Data

Aug. 14, 2003 (KR) ..... 10-2003-0056428

(51) Int. Cl.
*H01J 17/49* (2006.01)

(52) U.S. Cl. ..... 313/585; 313/586; 313/587

(58) Field of Classification Search ..... 313/582–587; 315/169.4; 345/37, 41, 60
See application file for complete search history.

(56) References Cited

U.S. PATENT DOCUMENTS

| | | | | |
|---|---|---|---|---|
| 6,333,599 | B1 * | 12/2001 | Kawanami et al. | 313/582 |
| 6,512,337 | B2 | 1/2003 | Hirano et al. | |
| 6,522,070 | B1 | 2/2003 | Nakazawa et al. | |
| 6,522,072 | B1 * | 2/2003 | Yura et al. | 313/582 |
| 6,828,736 | B2 * | 12/2004 | Homma | 315/169.4 |
| 6,838,826 | B2 | 1/2005 | Lin et al. | |
| 2001/0015621 | A1 | 8/2001 | Oniki | |
| 2001/0024921 | A1 * | 9/2001 | Hirano | 445/24 |
| 2002/0027413 | A1 | 3/2002 | Kanazawa et al. | |
| 2002/0063524 | A1 * | 5/2002 | Nakamura et al. | 313/582 |
| 2002/0135303 | A1 | 9/2002 | Hashimoto | |
| 2004/0000870 | A1 | 1/2004 | Kifune et al. | |

(Continued)

FOREIGN PATENT DOCUMENTS

| | | |
|---|---|---|
| JP | 10-334811 | 12/1998 |

(Continued)

*Primary Examiner*—Nimeshkumar D. Patel
*Assistant Examiner*—Christopher M Raabe
(74) *Attorney, Agent, or Firm*—H.C. Park & Associates, PLC

(57) ABSTRACT

Embodiments of the present invention offer an improved PDP that offers a lowered discharge initiation voltage as well as improved efficiency of discharge. The PDP may satisfy the equation $180 \leqq (A+B)+P\times 0.1 \leqq 240$ in which A is a distance between opposite recessed portion of a pair of a first electrode and a second electrode; it is a distance between opposite projection portions of the pair of the first electrode and the second electrode, and P is a gas pressure of a discharge gas contained in the discharge space. In another embodiment a gas pressure of a gas trapped in a discharge space (e.g., "cell" or "discharge cell") may be over 450 Torr. Additionally, each opposing end of the first electrode and the second electrode may include a recessed portion and a projection portion such that a gap interposed between the opposing end portions varies in width.

17 Claims, 8 Drawing Sheets

U.S. PATENT DOCUMENTS

| | | | |
|---|---|---|---|
| 2004/0051457 | A1 | 3/2004 | Kimura et al. |
| 2004/0263077 | A1 | 12/2004 | Kao et al. |

FOREIGN PATENT DOCUMENTS

| | | |
|---|---|---|
| JP | 11-096921 | 4/1999 |
| JP | 11096921 | 4/1999 |
| JP | 11-126561 | 5/1999 |
| JP | 2000-323045 | 11/2000 |
| JP | 2001-345054 | 12/2001 |
| JP | 2002-245943 | 8/2002 |
| JP | 2003-132805 | 5/2003 |
| KR | 19990065408 | 8/1999 |
| KR | 20030003645 | 1/2003 |
| KR | 102004002308 | 1/2004 |

* cited by examiner

PLASMA DISPLAY PANEL HAVING IMPROVED EFFICIENCY

CROSS REFERENCE TO RELATED APPLICATIONS

This application is a continuation of prior application Ser. No. 10/917,319, filed Aug. 13, 2004 now U.S. Pat. No. 7,095,174, which claims priority to and the benefit of Korean Patent Application No. 2003-56428, filed on Aug. 14, 2003, which are all hereby incorporated by reference for all purposes as if fully set forth herein.

BACKGROUND OF THE INVENTION

1. Field of the Invention

The present invention relates to a plasma display panel (PDP), and more particularly, to a PDP having high discharge efficiency.

2. Description of the Related Art

For many years, television screens have been manufactured using cathode-ray-tube (CRT) technology. In a CRT television, an electron gun shoots a beam of electrons inside a glass tube. The electrons impact phosphor atoms at the screen (e.g., the wide end of the tube). In response, the excited phosphor atoms light up. Illuminating various areas of the phosphor coating with different colors at particular intensities produces the television image. Crisp images are the hallmark of CRT televisions, but such devices are bulky because a wide screen requires a correspondingly long electron gun in order for the electron stream to reach all parts of the screen.

A newer technology is the plasma display panel (PDP), which offers a wide screen that is relatively thin (e.g., approximately 6"). Put simply, a PDP forms an image by illuminating thousands of pixels, each made of a red, blue, and green fluorescent light. Like a CRT television, a PDP produces a full spectrum of colors by varying the illumination intensity of the different lights.

The central element in each fluorescent light is a plasma, e.g., a gas comprised of free-flowing ions and electrons. When an electric current is run through the plasma, free electrons collide with the gas atoms, causing them to release photons of energy. The gas atoms mostly used in PDP's emit ultraviolet photons that are invisible to the human eye, but which may be used to excite visible light photon, as explained below.

In a conventional PDP, xenon or neon gas is trapped in hundreds of thousands of tiny cells positioned between two plates of glass. Strips of electrodes are sandwiched between the glass plates, on both sides of the cells. Mounted above the cells are the transparent display electrodes, which are surrounded by an insulating dielectric material and covered by a magnesium oxide protective layer. Behind the cells, along the neon glass plate, are the address electrodes. Both the address electrodes and the display electrodes extend across the entire screen to form a grid. In the grid, the address electrodes are arranged in vertical columns and the display electrodes are arranged in horizontal rows. To ionize the gas in a particular cell, a computer associated with the PDP charges the electrodes that interact at that cell. It does this many times per second, charging each cell in turn.

When intersecting electrodes are charged (e.g., a voltage difference is created between them), electric current flows through the gas in the cell. This generates a fast flow of charged particles, which stimulates the gas atoms to release ultraviolet photons.

The inside walls of each cell are coated with a phosphor material (e.g., a material that absorbs the energy of an incident ultraviolet photon and emits a visible light photon). Thus, when impacted by the ultraviolet photons, the red, blue or green phosphor material emits red, blue or green light. Because every pixel is made up of a subpixel containing a red light phosphor, a subpixel containing a blue light phosphor and a subpixel containing a green light phosphor, the colors blend together to generate the overall color of the pixel.

By varying the pulses of current flowing through each cell, the PDP computer can decrease or increase the intensity of each subpixel color to create many combinations of red, green and blue. In this manner, a PDP can be made to produce different colors across the entire spectrum.

PDPs are categorized into alternating current (AC) PDPs and direct current (DC) PDPs. In a DC PDP, each electrode is directly exposed to the gas contained in a discharge cell, and voltage applied to each electrode is directly applied to the gas. In an AC PDP, respective electrodes are separated from the gas by a dielectric layer and do not absorb charged particles generated in discharge. Instead, the charged particles form wall charges, and the wall charges cause discharge.

Referring to FIG. 1 a conventional PDP includes first and second substrates 10 and 11 having inner surfaces facing each other. Address electrodes 12 and a dielectric layer 13 are sequentially formed above the second substrate 11. Barrier ribs 14 separating cells and preventing electric and optical cross talk between the pixels are formed on the dielectric layer 13. A fluorescent layer 15 is formed on the inner surface of each of the cells.

X electrodes X and Y electrodes Y are formed on the first substrate 10 such that the X electrodes X and the Y electrodes Y intersect the address electrodes 12 at right angles. Each of the X electrodes X includes a transparent electrode 16*x* and a bus electrode 17*x*, and each of the Y electrodes Y includes a transparent electrode 16*y* and a bus electrode 17*y*. The X electrodes X and the Y electrodes Y intersect the address electrodes 12 at respective cells.

A dielectric layer 18 covering the X electrodes X and Y electrodes Y is formed on the inner surface of the first substrate 10. A protection layer 19 composed of MgO is formed on the dielectric layer 18. A gas, such as xenon or neon, is injected into the cells interposed between the first and second substrates 10 and 11.

A voltage is applied to the address electrode 12, and to one of the X electrodes X, and the Y electrodes Y. Subsequently, an address discharge occurs between the electrodes. Discharged particles then migrate to the lower surface of the dielectric layer 18 of the first substrate 10. A sustain discharge occurs at the surface of the dielectric layer 18 by applying predetermined voltage between a X electrode X and a Y electrode Y of a particular cell. As a result, the gas contained in the cell is ionized to form a plasma, and a fluorescent substance coated on an inside surface of the cell is excited to produce a colored pixel.

Referring to FIG. 2, the sustain discharge occurs between the transparent electrodes 16*x* and 16*y* of the X electrodes X and the Y electrodes Y across a predetermined gap G1.

Optimally, initiation of the sustain discharge should occur in a wide area such that a discharge starting with the gap G1 is spread over an entire cell. However, when a conventional gap G1 is formed at predetermined intervals as shown in FIG. 2, initiation of the sustain discharge occurs locally, causing the spread of the discharge to be non-uniformly distributed. Consequently, a uniform field over the entire surface of the transparent electrodes 16*x* and 16*y* is not formed when the discharge is generated by applying a voltage to the X electrodes X and the Y electrodes Y, which are sustain discharge electrodes. Because a uniform field is not created, there is a portion of the transparent electrode that contributes little to the discharge. This unnecessary portion decreases the discharge efficiency of a discharge cell, and also decreases luminance by covering (e.g., blocking) an area of the discharge cell.

A solution is needed that increases the discharge efficiency of each cell by ensuring a more uniform distribution of the sustain discharge.

SUMMARY OF THE INVENTION

The invention is directed to a plasma display panel (PDP), having high definition due to a reduced pixel size, as well as a lowered discharge initiation voltage and an improved efficiency of discharge.

In one embodiment an improved PDP includes a first substrate. A plurality of pairs of first electrodes and second electrodes are formed on the first substrate extending parallel with each other. The first electrode and the second electrode are configured to generate a sustain discharge. The first electrode and the second electrode each include at least one recessed portion and at least one projection portion such that the recessed portions and the projection portions of both electrodes face each other. Additionally, the PDP includes a second substrate positioned on a side of the first substrate on which the first electrode and the second electrode are formed such that a discharge space is interposed between the first substrate and the second substrate. A plurality of address electrodes are formed on the second substrate and face the first substrate. Barrier ribs partition the discharge space between the first substrate and the second substrate into a plurality of discharge cells, the discharge forms to contain a discharge gas therein. And a fluorescent substance is formed in each of the discharge cells, wherein the plasma panel display satisfies $180 \leqq (A+B)+P\times0.1 \leqq 240$ wherein A is a distance between opposite recessed portions of a pair of the first electrode and the second electrode, B is a distance between opposite projection portions of a pair of the first electrode and the second electrode, and P is gas pressure of a discharge gas contained in the discharge space.

In another embodiment of the invention, an improved PDP includes a first substrate. A plurality of pairs of first electrodes and second electrodes may be formed on the first substrate to extend parallel with each other, and may be configured to generate a sustain discharge.

Additionally, the first electrodes may each include at least one recessed portion. The second electrodes may each include at least one projection portion. The first electrode and the second electrode may be positioned such that the projection portions of the first electrode and recessed portions of the second electrode face each other. The improved PDP may also include a second substrate positioned on a side of the first substrate on which the first electrode and the second electrode are formed such that a discharge space is interposed between the first substrate and the second substrate. A plurality of address electrodes may be formed on the second substrate to face the first substrate. Barrier ribs may partition the discharge space between the first substrate and the second substrate into a plurality of discharge cells; and a fluorescent substance may be formed in each of the discharge cells, wherein a gas pressure of a gas trapped in the discharge space may be over 450 Torr.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Embodiments of the present invention offer an improved PDP that offers a lowered discharge initiation voltage as well as an improved efficiency of discharge. The PDP may satisfy the equation $180 \leqq (A+B)+P\times0.1 \leqq 240$ in which A is a distance between opposite recessed portion of a pair of a first electrode and a second electrode; B is a distance between opposite projection portions of the pair of the first electrode and the second electrode; and P is a gas pressure of a discharge gas contained in the discharge space. In another embodiment a gas pressure of a gas trapped in a discharge space (e.g., "cell" or "discharge cell") may be over 450 Torr. Additionally, the PDP may include a first substrate having formed therein a plurality of pairs of first and second electrodes. Each opposing end of the first electrode and the second electrode may include a recessed portion and a projection portion such that a gap interposed between the electrodes' opposing end portions has different widths.

Figure 1:
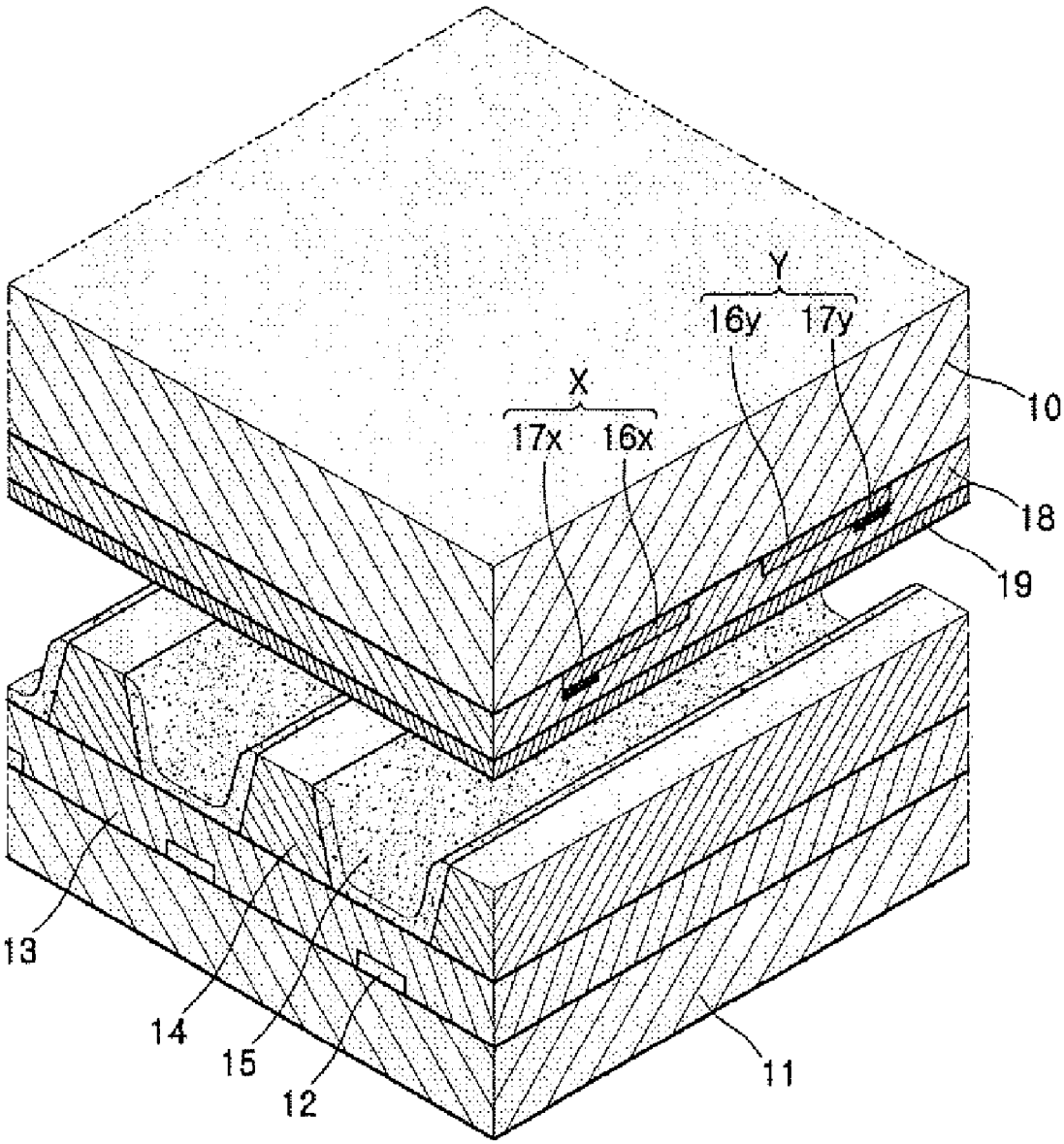
FIG. 1 (PRIOR ART)
FIG. 1 is an exploded perspective view of a conventional plasma display panel (PDP).
Figure 2:
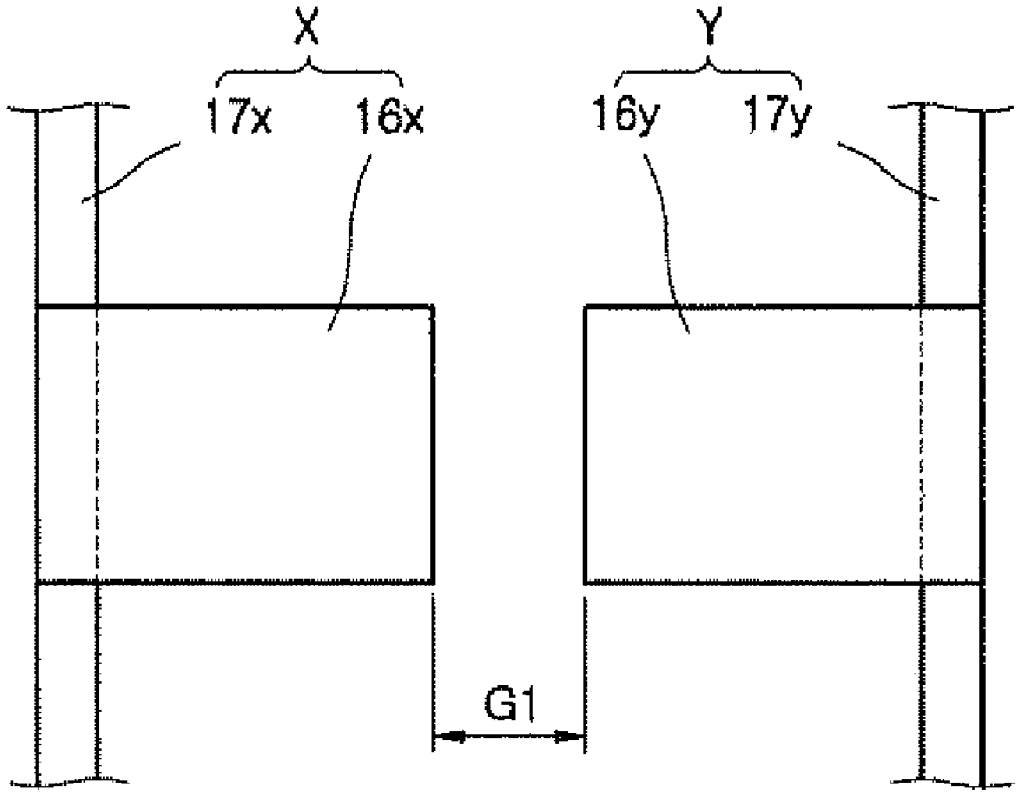
FIG. 2 (PRIOR ART)
FIG. 2 is a top view of sustain discharge electrodes of FIG. 1.
Figure 3:
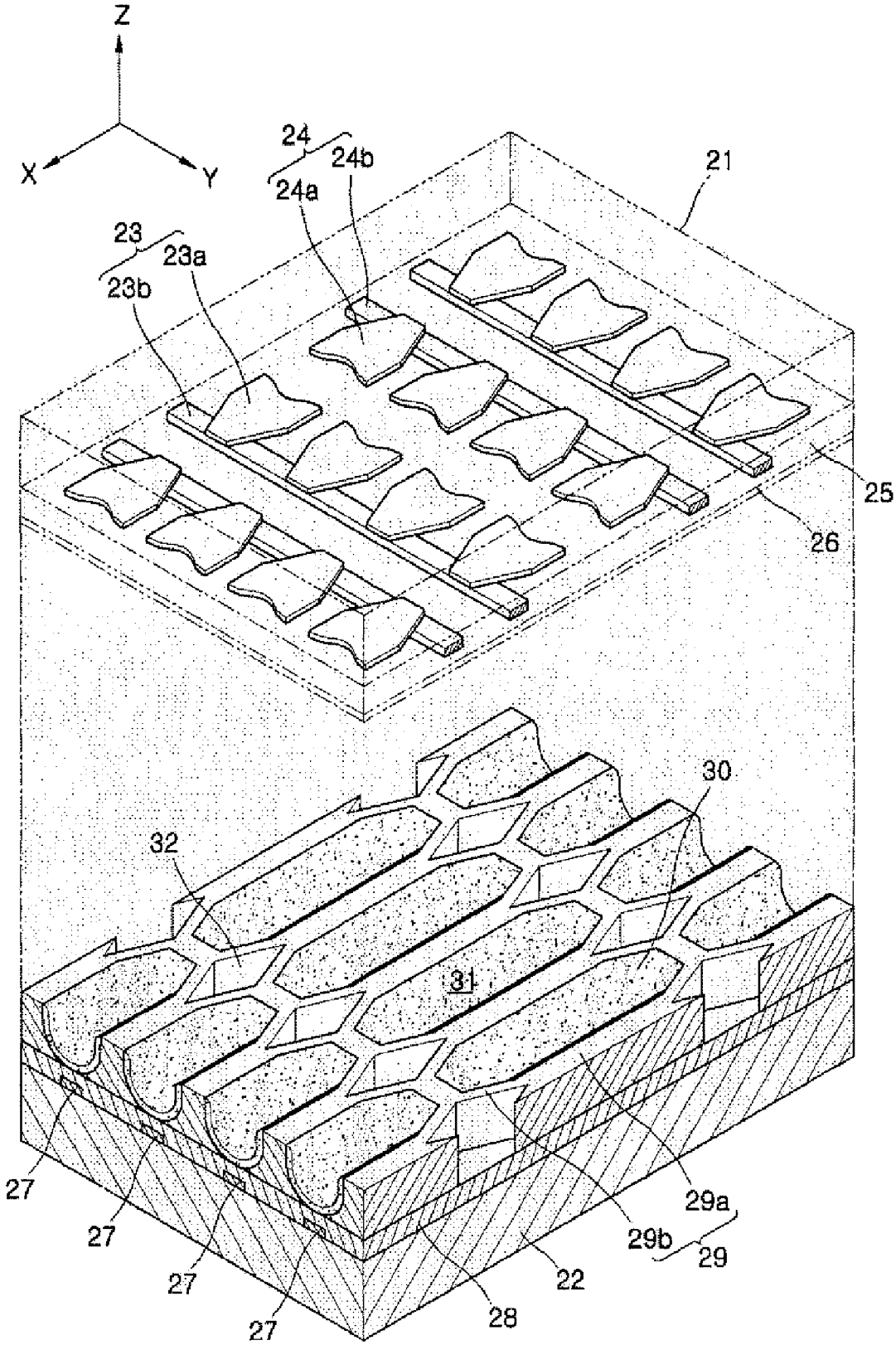
FIG. 3 is an exploded partial perspective view of a PDP with an octagonal barrier pattern according to an embodiment of the present invention.

FIG. 3 is an exploded partial perspective view of a plasma display panel (PDP) according to an embodiment of the present invention. As shown, the PDP includes a first substrate 21 and a second substrate 22. A discharge space exists between the first and second substrates, and is filled with a discharge gas such as neon (Ne) or xenon (Xe). Edges of the substrates are tightly sealed by a sealant such as frit glass, thereby combining the substrates to form the PDP.

A plurality of pairs of first electrodes 23 and second electrodes 24 are formed on a surface of the first substrate 21 that faces the second substrate 22, in a predetermined pattern, such as, but not limited to a striped pattern, for example. The first electrodes 23 may be X electrodes that corresponds to a common electrode. The second electrodes 24 may be Y electrodes that correspond to an scanning electrode. Both the first electrodes 23 and the second electrodes 24 may function as sustain discharge electrodes.

The first electrode and the second electrode 23 and 24 may respectively include transparent electrodes 23*a* and 24*a* composed of indium tin oxide (ITO), which is a transparent conductor, and bus electrodes 23*b* and 24*b* composed of silver (Ag) or gold (Au) to complement line resistances of the first electrode and the second electrode 23 and 24. The transparent electrodes 23*a* and 24*a*, and the bus electrodes 23*b* and 24*b* of the first electrode and the second electrode 23 and 24 may be formed by photolithography or screen printing. In either case, a black additive may be added to the bus electrodes 23*b* and 24*b* in order to improve contrast. The first electrode and the second electrode 23 and 24 will be described in further detail later.

Referring again to the PDP of FIG. 3, a first dielectric layer 25 is formed on the first substrate 21 to cover the first electrode and the second electrode 23 and 24. An MgO layer 26 may be formed by sputtering or depositing MgO on the first dielectric layer 25. The MgO layer 26 acts as a cathode during discharge.

Address electrodes 27 are formed on a surface of the second substrate 22 that faces the first substrate 21. The address electrodes 27 are patterned in a direction which is orthogonal to a longitudinal direction of the first electrode and the second electrode 23 and 24. A second dielectric layer 28 may be formed on the second substrate 22 to cover the address electrodes 27. In order to improve the brightness of the PDP, the second dielectric layer 28 may be white.

Barrier ribs 29 may be formed on the second dielectric layer 28 to partition the discharge space into a plurality of discharge cells 31. The barrier ribs 29 may function to prevent cross talk of light between the adjacent discharge cells 31. A fluorescent substance 30 spread over the upper surface of the second dielectric layer 28 may be surrounded by the barrier ribs 29 and side surfaces of the barrier ribs 29. Red (R), green (G), and blue (B) regions of the fluorescent substance 30 are formed in respective cells 31 in order to create a full spectrum color display. The discharge cells 31 each contain a discharge gas so that discharge will occur within a cell when an address voltage or a sustain discharge voltage is applied to the intersecting electrodes that correspond to that cell.

Depending on the embodiment, virtually any configuration that is capable of partitioning the discharge space into discharge cells 31 can be applied to the barrier ribs 29. In FIG. 3, an improved configuration is shown that includes an octagonal shape that partitions the discharge cells 31 and non-discharge regions 32 adjacent to the discharge cells 31. As shown, the non-discharge regions 32 are each surrounded by the ends of four of the discharge cells 31. Since no electrodes intersect in the non-discharge regions 32, no discharge occurs in these regions.

Figure 4:
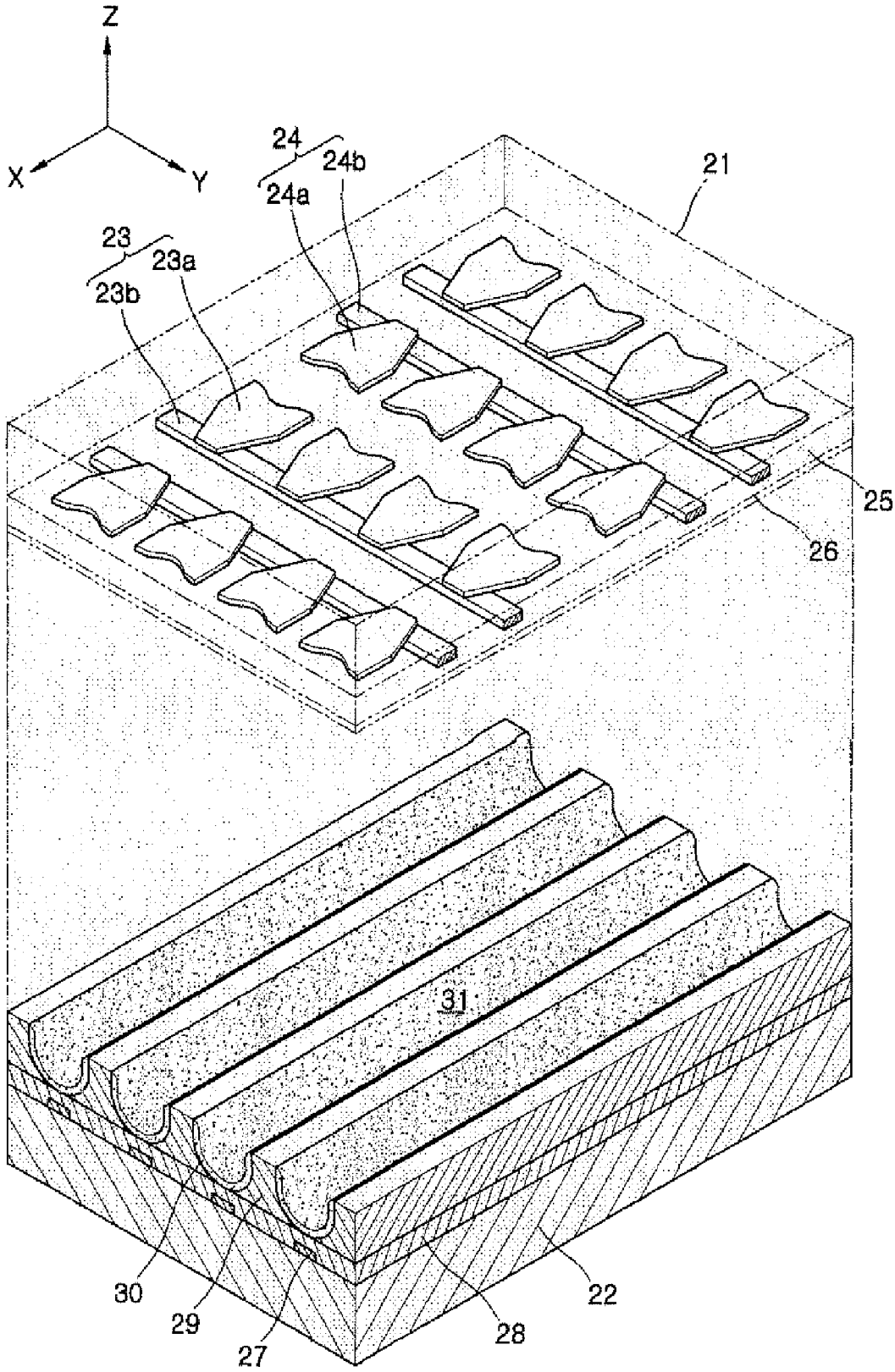
FIG. 4 is a partial exploded perspective view of a PDP with a striped barrier pattern according to another embodiment of the present invention.
Figure 5:
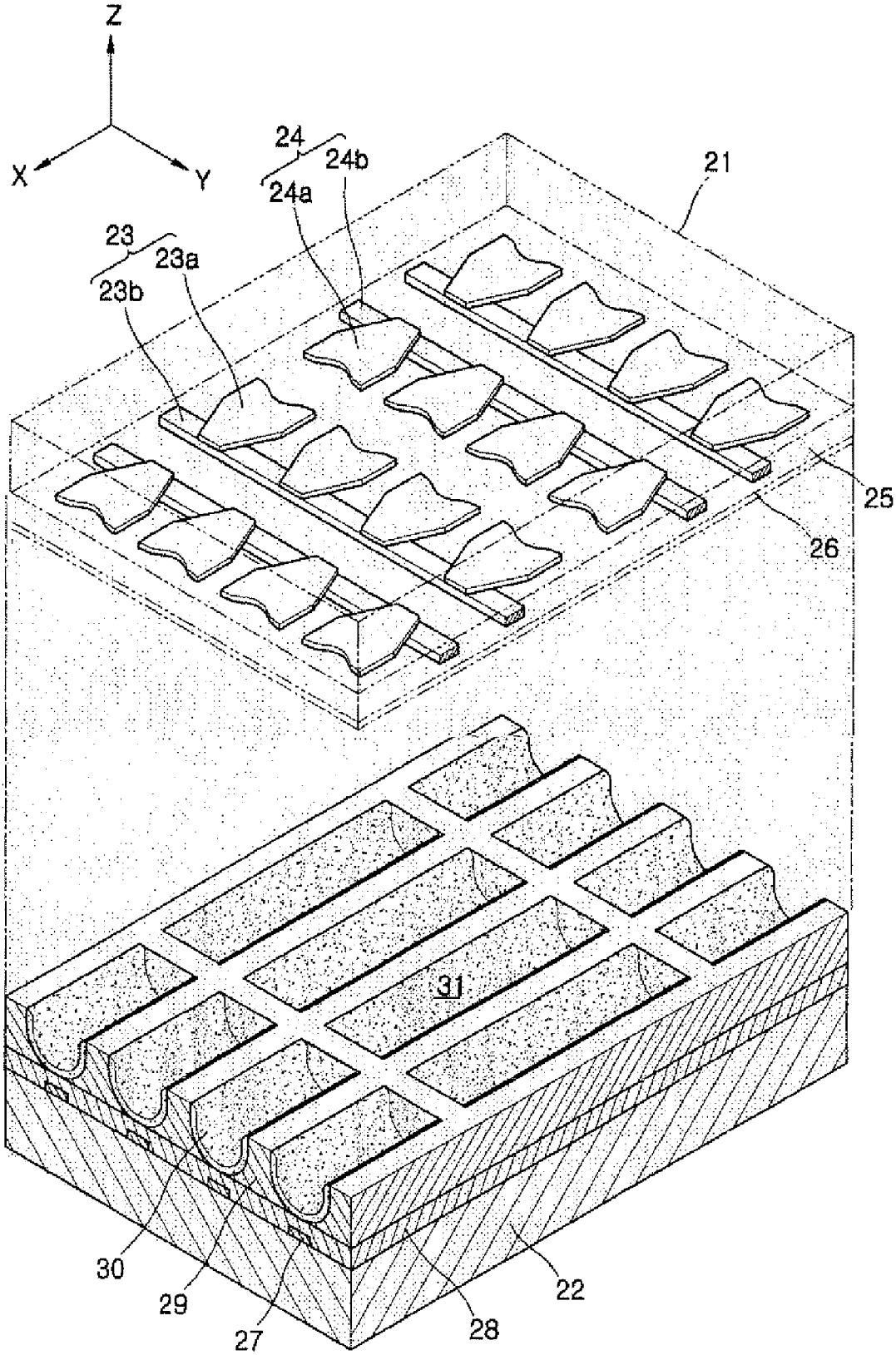
FIG. 5 is a partial exploded perspective view of a PDP with a lattice barrier pattern according to still another embodiment of the present invention.

In one embodiment, the discharge cells 31 neighboring each other along the first electrode and the second electrode 23 and 24 (in the Y direction) contact at least one common barrier rib 29. Additionally, a width of an end of the discharge cell 31 in the direction of the address electrode 27 (in the X direction) may be narrower than a width of the center of the discharge cell 31. A depth of the end of the discharge cell 31 may be less than a depth of the center of the discharge cell 31. Thus, a distance between the fluorescent substance 30 and the first electrode and the second electrode 23 and 24 may decrease at the end of the discharge cell 31 where the intensity of discharge is relatively weak. Such a configuration positions the fluorescent substance 30 closer to the first electrode and the second electrode 23 and 24, and thereby improves the efficiency of converting the vacuum ultraviolet rays generated in discharge into visible light. Configurations of barrier ribs, however, are not limited as described above. For example, the discharge cells 31 may be arranged in a striped pattern, as shown in FIG. 4, or in a lattice pattern, as shown in FIG. 5.

Referring again to FIG. 3, each of the first electrodes 23 and the second electrodes 24 respectively include transparent electrodes 23*a* and 24*a* that are projected (e.g., cantilevered) over one of the discharge cells 31. In one embodiment, and a sustain discharge is caused by the transparent electrodes 23*a* and 24*a*.

Figure 6:
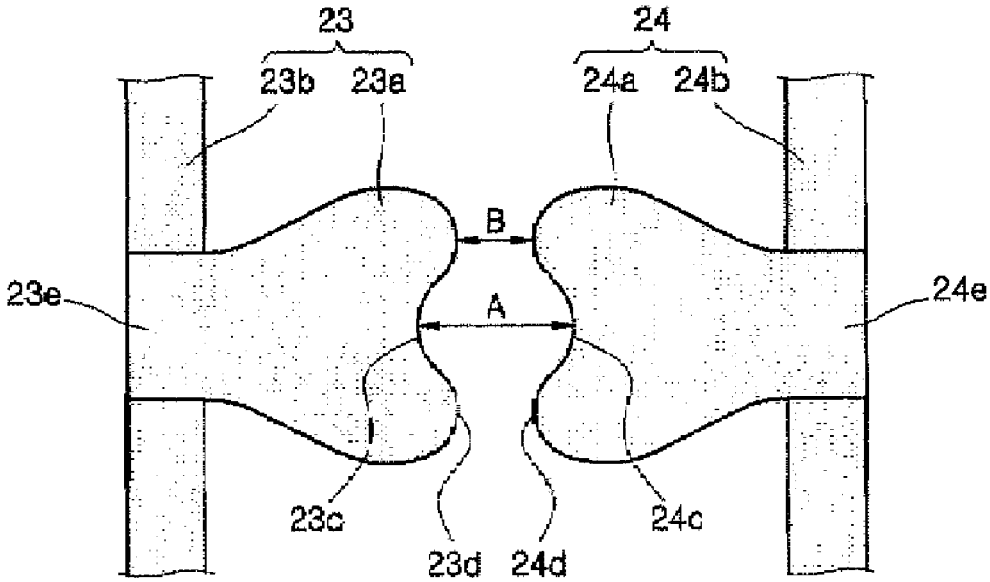
FIG. 6 is a top view of first and second electrodes according to an embodiment of the present invention.
Figure 7:
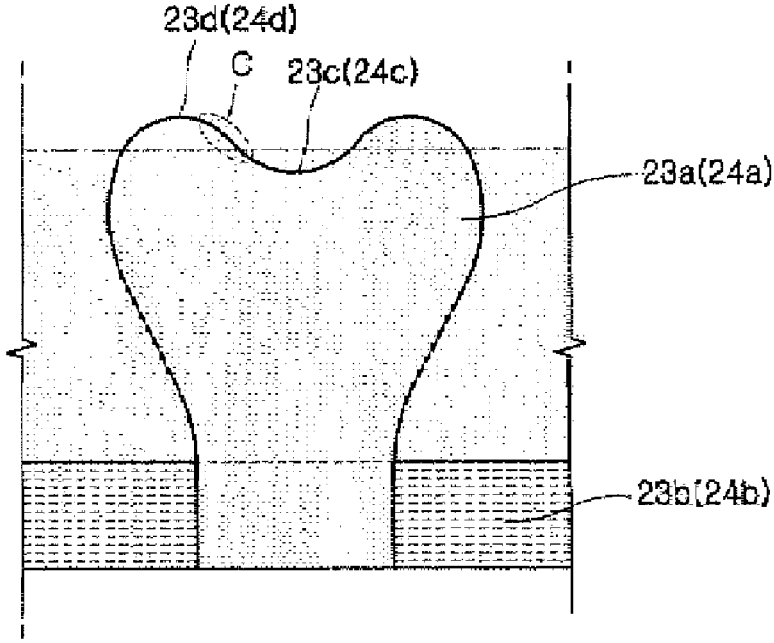
FIG. 7 is a top view of transparent electrodes of the electrodes of FIG. 6.

Referring to FIGS. 6 and 7, adjacent ends of the transparent electrodes 23*a* and 24*a* may be manufactured to include respective recessed portions 23*c* and 24*c* and projection portions 23*d* and 24*d*, respectively. Thus, in one embodiment, transparent electrode 23*a* may have a recessed portion 23*c* and at least two projection portions 23*d*. Additionally, the second electrode 24*a* may include a recessed portion 24*c* and at least two projection portions 24*d*. According to an embodiment of the present invention, the recessed portions 23*c* and 24*c* may be disposed in the center of opposing ends of the respective transparent electrodes 23*a* and 24*a*, and the projection portions 23*d* and 24*d* may be disposed at the edges of the opposing ends. In one embodiment, the projection portions 23*d* and 24*d* may be disposed symmetrically on both sides of the recessed portions 23*c* and 24*c*.

FIG. 6 illustrates a pair of transparent electrodes 23*a* and 24*a*, in which there is a long gap A between the recessed portions 23*c* and 24*c* and a short gap B between the projection portions 23*d* and 24*d*. The long gap A is longer than the short gap B, as shown in FIG. 6.

In use, a sustain discharge between the transparent electrodes 23*a* and 24*a* starts at the gaps between the transparent electrodes 23*a* and 24*a*. According to an embodiment of the present invention, the sustain discharge begins at the short gap B and spreads to the long gap A. In this manner, the sustain discharge is uniformly distributed over the entire discharge cell. The discharge spreads to the recessed portions 23*c* and 24*c*, and thus ensures a stable discharge. The projection portions 23*d* and 24*d* reduce the width of the conventional (e.g., mono-width) gap formed between the transparent electrodes 23*a* and 24*a*. In one embodiment, the gap reduction achieved by embodiments of the present invention reduces a discharge initiation voltage Vf.

Referring to FIG. 7, the recessed portions 23*c* and 24*c* may have a predetermined curvature and extend from the projection portions 23*d* and 24*d*. Connection portions C connect the recessed portions 23*c* and 24*c* and the projection portions 23*d* and 24*d*, and are not parallel to the length direction of the bus electrode 23*b* and 23*c*. In one embodiment, the sustain discharge spreads from the short gap B to the long gap A along the connection portions C. However, in one embodiment, the discharge does not start until a voltage between the first electrode and the second electrode 23 and 24 approximately equals the discharge initiation voltage. Once the discharge is generated and repeated, the discharge grows geometrically as it diffuses from the short gap B and is led to the long gap A via the diffusion.

Figure 8:
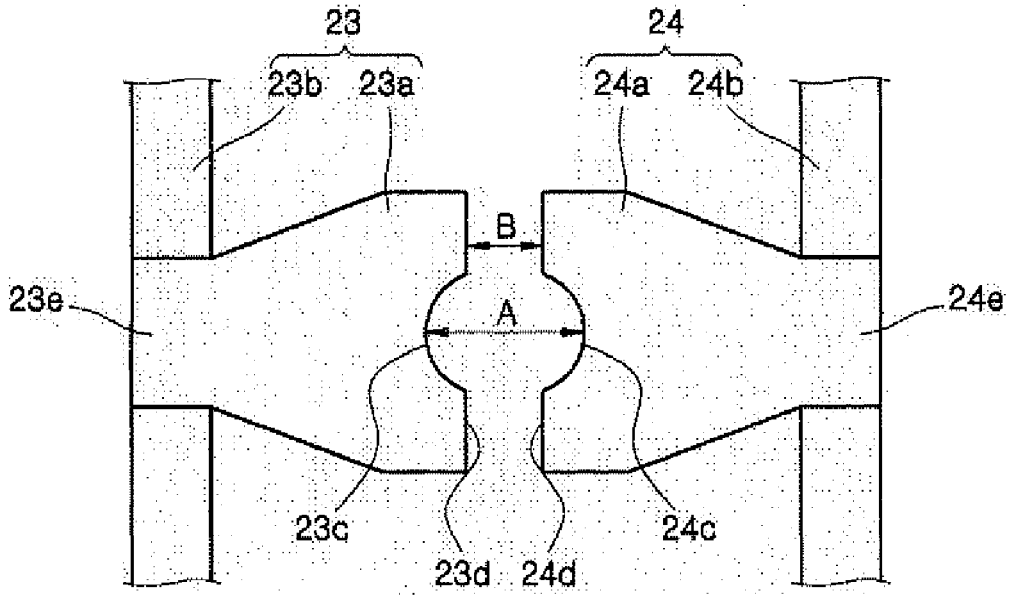
FIG. 8 is a top view of first and second electrodes according to another embodiment of the present invention.
Figure 9:
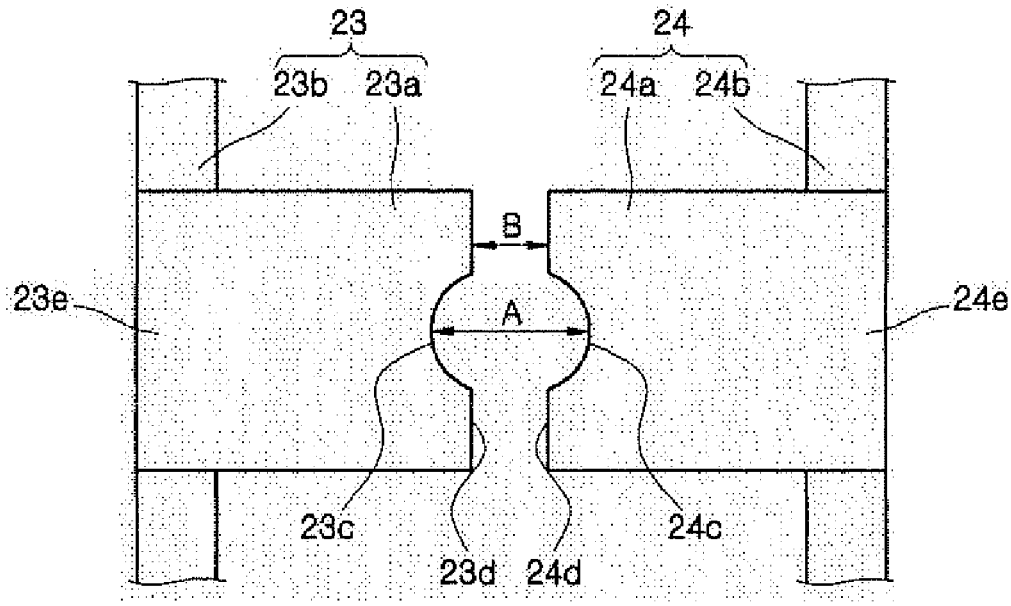
FIG. 9 is a top view of first and second electrodes according to still another embodiment of the present invention.

Referring to FIGS. 8 and 9, another embodiment is shown in which the projection portions 23*d* and 24*d* are blunt (e.g., not curved), while the recessed portions 23*c* and 24*c* are curved. Use of such a configuration also lowers the discharge initiation voltage Vf.

Although not shown, recessed portions 23*c* or 24*c* and/or projection portion 23*d* or 24*d* may be formed in only one electrode of a pair of the first electrode and the second electrode 23 and 24.

The transparent electrodes 23*a* and 24*a* may each also include connection portions 23*e* and 24*e* that have outside edges which correspond to outside edges of the discharge cells 31, but are concavely formed in the direction inside (e.g., toward the gaps). The connection portions 23*e* and 24*e* connect the transparent electrodes 23*a* and 24*a* to the bus electrodes 23*b* and 24*b*. Because the connection portions 23*e* and 24*e* contribute little to the sustain discharge, the width of the connection portions 23*e* and 24*e* may be made narrower than other portions of the transparent electrode 23*a* and 24*a* in order to increase aperture efficiency.

Referring again to FIG. 8, the connection portions 23*e* and 24*e* may be applied to an embodiment in which the projection portions 23*d* and 24*d* are not curved and only the recessed portions 23*c* and 24*c* are formed with curvature. Referring to FIG. 9, the width of the connection portions 23*e* and 24*e* may be identical to the width of the transparent electrodes 23*a* and 24*a*.

In one embodiment the long gap A, the short gap B, and the pressure P of the discharge gas in the discharge space satisfy Equation 1, whereby the discharge initiation voltage Vf is lowered and efficiency is improved.

$$180 \leqq (A+B)+P\times 0.1 \leqq 240 \quad (1)$$

In one embodiment, a high concentration Xe discharge gas containing more than 10% Xe by volume is used.

The efficiency of the discharge may be improved by increasing the gas pressure P of the discharge gas. When the gas pressure P of the discharge gas is increased, the quantity of Xe gas increases, and therefore, the number of particles capable of being excited increases. Consequently, luminance and discharge efficiency both increase.

On the other hand, if the gas pressure P is increased as described above, the momentum, and hence, the temperature, of the electrons decreases. Thus, it may be necessary to increase the discharge initiation voltage Vf for initiating discharge. However, decreasing the gap between the electrodes lowers the discharge initiation voltage Vf, which compensates for the increase in Vf formerly necessitated by the increased pressure.

A PDP according an embodiment of to the present invention may have a lower discharge initiation voltage Vf due to the short gap B. When the relationship between the gaps A and B and the gas pressure P is properly controlled, the efficiency of the PDP may be improved and the discharge initiation voltage Vf may be lowered. For example, the difference between the long gap A and short gap B may be about 30 to 50 μm.

On the other hand, when a difference between the long gap A and short gap B is too large, discharge initiated at the short gap B has difficult spreading to the long gap A. Therefore, when the short gap B is decreased in order to lower the discharge initiation voltage Vf, the long gap A is also decreased. A new variable C(=A+B) in which the long gap A and short gap B are summed is set. The gas pressure P of the discharge gas may then be set proportional to the variable C. For example, as mentioned above, when the gas pressure P is increased, the discharge initiation voltage Vf increases. However, if the short gap B is decreased to lower the discharge initiation voltage Vf, and the long gap A is decreased to maintain the difference between the short gap B and the long gap A, C also decreases.

A function f is given by summing C and 0.1 times the gas pressure P. Thus, $$f=C+(P\times 0.1)$$

Figure 10:
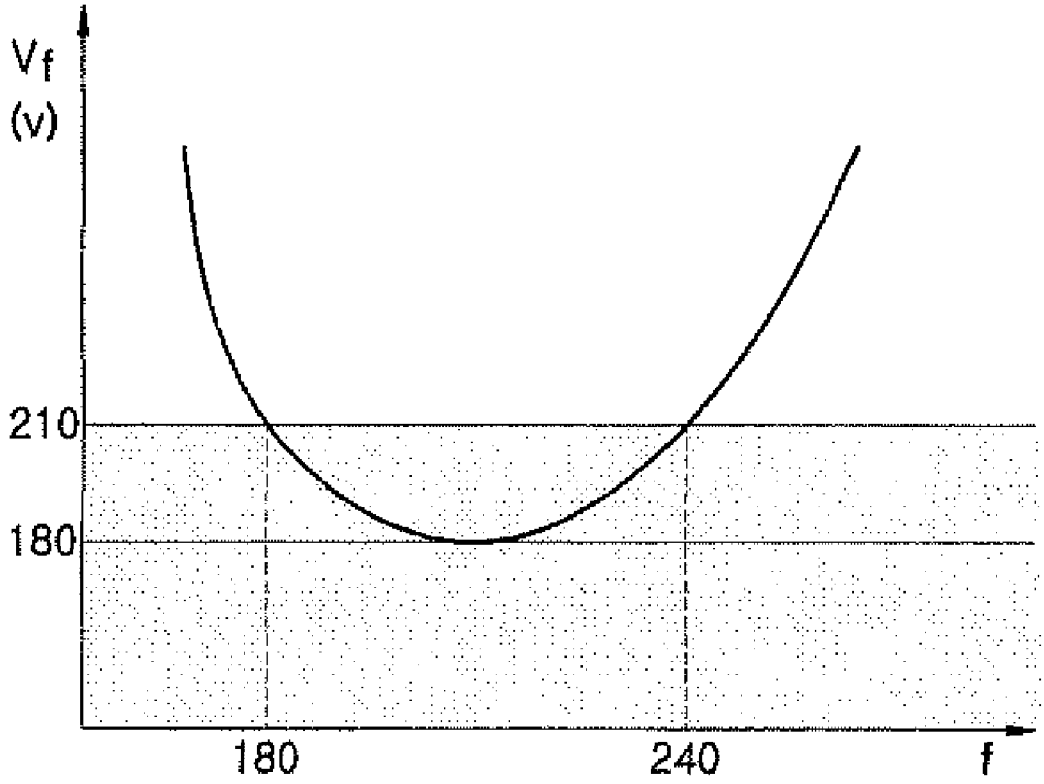
FIG. 10 is a graph illustrating a relationship between a discharge initiation voltage and a function of a long gap, a short gap, and gas pressure.

FIG. 10 illustrates a relationship between the function f and the discharge initiation voltage Vf.

Referring to FIG. 10, the discharge initiation voltage Vf may have a minimum of 180 V. The discharge initiation voltage Vf may also be under 210 V. Therefore, C and gas pressure P are controlled such that the discharge initiation voltage Vf in the range of about is 180 to about 210 V. This occurs when the value of the function f is 180 to 240. That is, when the value of f is greater than about 180 and less than about 240, the discharge initiation voltage Vf is in the optional range of about 180 to about 210 V. In this manner, the value of C capable of producing the proper discharge initiation voltage according to the gas pressure is obtained.

Table 1 shows the value of the mathematical function f that produces the proper discharge initiation value as described above to obtain the optimum efficiency according to the gas pressure P.

TABLE 1

| Gas pressure (P) (Torr) | Value (μm) of C(=A + B) according to gas pressure | f(C + P × 0.1) | Efficiency |
|---|---|---|---|
| 250 | 175~210 | 200~235 | 1 |
| 275 | 170~210 | 197.5~237.5 | 1.05 |
| 300 | 165~210 | 195~240 | 1.03 |
| 325 | 160~200 | 192.5~232.5 | 1.05 |
| 350 | 155~195 | 190~230 | 1 |
| 375 | 153~190 | 190.5~227.5 | 1.01 |
| 400 | 150~190 | 190~230 | 1.04 |
| 425 | 148~190 | 190.5~232.5 | 1.03 |
| 450 | 143~187 | 188~232 | 1.11 |
| 475 | 140~187 | 187.5~234.5 | 1.17 |
| 500 | 137~187 | 187~237 | 1.24 |
| 525 | 135~185 | 187.5~237.5 | 1.29 |
| 550 | 133~185 | 185~240 | 1.38 |
| 575 | 125~180 | 182.5~237.5 | 1.42 |
| 600 | 120~177 | 180~237 | 1.46 |

In Table 1, when the gas pressure (P) is 250 Torr, the efficiency is defined as 1, and changes of the efficiency according to changes in the gas pressure P are examined. The values of C indicates the range of the value of C capable of maintaining the discharge voltage at 180 to 210 V for given gas pressures, and the value of f is fixed according to the value of C and P.

Referring to Table 1, when the gas pressure P is increased, the efficiency is also increased, and when the gas pressure P is over 450 Torr, the efficiency is increased greatly. When the gas pressure P is over 600 Torr, the panel does not drive properly. Therefore, the gas pressure P should under 600 Torr.

The PDP according to the present invention as described above may provide the following effects. First, controlling a gap between sustain electrodes and gas pressure of a discharge gas may lower a discharge initiation voltage and increase efficiency. Second, aperture efficiency may be improved by reducing the size of the sustain electrodes and high definition may be possible by reducing the size of unit pixels. Finally, luminance may be improved by increasing the gas pressure of the discharge gas.

Configurations and patterns of the first electrode 23, the second electrode 24, and the address electrodes 27 are not limited to those illustratively depicted in the Figures and described herein, but may be changed to suit various design conditions.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a first substrate;

a plurality of pairs of a first electrode and a second electrode formed on the first substrate and extending parallel with each other, the first electrode and the second electrode generating a sustain discharge, and each of the first electrode and the second electrode including a recessed portion and a projection portion such that the recessed portion and the projection portion of the first electrode face the recessed portion and the projection portion of the second electrode;

a second substrate on a side of the first substrate on which the first electrode and the second electrode are formed such that a discharge space is interposed between the first substrate and the second substrate;

a plurality of address electrodes formed on the second substrate and facing the first substrate;

barrier ribs partitioning the discharge space between the first substrate and the second substrate into a plurality of discharge cells; and a fluorescent substance formed in each of the discharge cells, wherein gas pressure of discharge gas in the discharge space is over 450 Torr, wherein the recessed portions of the first electrode and the second electrode are opposite with each other and the projection portions of the first electrode and the second electrode are opposite with each other, and wherein the opposite recessed portions of a pair of the first electrode and the second electrode and the opposite projection portions of the pair of the first electrode and the second electrode define a discharge gap.

2. The plasma display panel of claim 1, wherein the recessed portions is located at the center of the respective ends of the first electrode and the second electrode.

3. The plasma display panel of claim 1, wherein the projection portion is located on at least one side of the respective ends of the first electrode and the second electrode.

4. The plasma display panel of claim 3, wherein the projection portion is disposed symmetrically on both sides of each of the first electrode and the second electrode.

5. The plasma display panel of claim 1, wherein the recessed portion has a predetermined curvature.

6. The plasma display panel of claim 1, wherein each of the first electrode and the second electrode has a projection electrode that is projected to face each other, and the recessed portion and the projection portion are included in the projection electrode.

7. The plasma display panel of claim 6, wherein respective ends of the projection electrodes of the first electrode and the second electrode farthest from each other are narrower than other sections of the projection electrodes.

8. The plasma display panel of claim 1, wherein the first electrode and the second electrode respectively include bus electrodes and transparent electrodes extending from the bus electrodes facing each other, and each of the transparent electrodes includes the recessed portion and the projection portion.

9. The plasma display panel of claim 1, wherein ends of the respective transparent electrodes of the first electrode and the second electrode farthest from each other are narrower than other sections of the projection electrodes.

10. The plasma display panel of claim 1, wherein the barrier rib extends in the same direction as the address electrodes, between the address electrodes.

11. The plasma display panel of claim 1, wherein the barrier ribs have a lattice shape formed to surrounding the discharge cells.

12. The plasma display panel of claim 1, wherein the barrier ribs further partition non-discharge regions around the discharge cells.

13. The plasma display panel of claim 12, wherein the barrier ribs have an octagonal configuration surrounding each of the discharge cells.

14. The plasma display panel of claim 1, wherein the gas pressure of the discharge gas in the discharge space is under 600 Torr.

15. The plasma display panel of claim 1, wherein an initiation voltage of the sustain discharge is over 180 V and under 240 V.

16. The plasma display panel of claim 1, wherein the discharge gas includes at least xenon Xe.

17. The plasma display panel of claim 16, wherein the concentration of the xenon Xe of the discharge gas is at least 10% in terms of gas pressure.

* * * * *